US009163518B2

(12) United States Patent
Devore et al.

(10) Patent No.: US 9,163,518 B2
(45) Date of Patent: Oct. 20, 2015

(54) FULL COVERAGE TRAILING EDGE MICROCIRCUIT WITH ALTERNATING CONVERGING EXITS

(75) Inventors: Matthew A. Devore, Manchester, CT (US); Eleanor D. Kaufman, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 2331 days.

(21) Appl. No.: 12/050,408

(22) Filed: Mar. 18, 2008

(65) Prior Publication Data

US 2009/0238695 A1 Sep. 24, 2009

(51) Int. Cl.
*F01D 5/18* (2006.01)

(52) U.S. Cl.
CPC ..... *F01D 5/187* (2013.01); *F05D 2240/122* (2013.01); *F05D 2240/304* (2013.01)

(58) Field of Classification Search
CPC ..... F01D 5/187; F01D 5/188; F01D 5/189; F05D 2240/304; F05D 2260/202; F05D 2260/204; F02C 7/12
USPC ..... 415/115; 416/97 R
See application file for complete search history.

(56) References Cited

U.S. PATENT DOCUMENTS

| | | | | |
|---|---|---|---|---|
| 5,328,331 | A | 7/1994 | Bunker et al. | |
| 2005/0281667 | A1* | 12/2005 | Liang | 415/115 |
| 2008/0050243 | A1 | 2/2008 | Liang | |

FOREIGN PATENT DOCUMENTS

| | | | |
|---|---|---|---|
| EP | 1091092 | A2 | 4/2001 |
| EP | 1847684 | A1 | 10/2007 |

* cited by examiner

*Primary Examiner* — Dwayne J White
*Assistant Examiner* — Adam W Brown
(74) *Attorney, Agent, or Firm* — Bachman & LaPointe, P.C.

(57) ABSTRACT

A turbine engine component has an airfoil portion with a pressure side wall, a suction side wall, and a trailing edge. The turbine engine component further has at least one first cooling circuit core embedded within the pressure side wall, with each first cooling circuit core having a first exit for discharging a cooling fluid, at least one second cooling circuit core embedded within the suction side wall, with each second cooling circuit core having a second exit for discharging a cooling fluid, and the first and second exits being aligned in a spanwise direction of the airfoil portion.

18 Claims, 4 Drawing Sheets

FULL COVERAGE TRAILING EDGE MICROCIRCUIT WITH ALTERNATING CONVERGING EXITS

BACKGROUND

The present application is directed to an airfoil portion of a turbine engine component.

Some existing trailing edge microcircuits consist of a single core 10 inserted into a mainbody core and run out the center of a trailing edge 12 of an airfoil portion 14 of a turbine engine component, or to a pressure side cutback (see FIG. 1). Other schemes run two cores 10 and 10' out the aft end of the trailing edge 12 (see FIG. 2) of the airfoil portion 14. Of the two microcircuits in this configuration, one behaves similar to other trailing edge microcircuits while the other dumps to the pressure side upstream of the trailing edge.

SUMMARY OF THE INVENTION

A turbine engine component having an airfoil portion with a pressure side wall, a suction side wall, and a trailing edge is described herein. The turbine engine component comprises at least one first cooling circuit core embedded within the pressure side wall, each said first cooling circuit core having a first exit for discharging a cooling fluid, at least one second cooling circuit core embedded within the suction side wall, each said second cooling circuit core having a second exit for discharging a cooling fluid, and said first and second exits being aligned in a spanwise direction of said airfoil portion.

Also described herein is a process for forming a turbine engine component. The process broadly comprises the steps of forming an airfoil portion having a pressure side wall, a suction side wall, and a trailing edge, forming a trailing edge cooling system which comprises at least one first cooling circuit core within said pressure side wall and at least one second cooling circuit core having within said suction side wall, and forming said at least one first cooling circuit core to have a first exit and forming said at least one second cooling circuit core to have a second exit aligned with said first exit in a spanwise direction of said airfoil portion.

Other details of the invention, as well as other objects and advantages attendant thereto are set forth in the following detailed description and the accompanying drawings, wherein like reference numerals depict like elements.

DETAILED DESCRIPTION OF THE PREFERRED EMBODIMENT(S)

Figure 3:
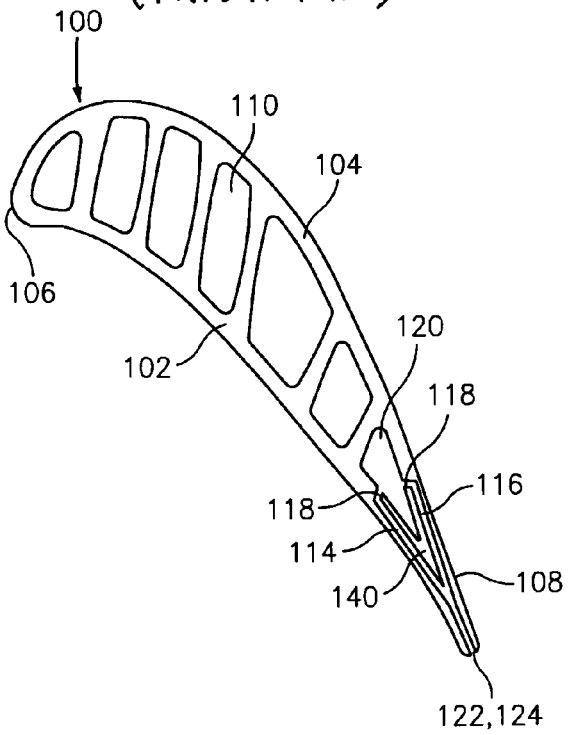
FIG. 3 illustrates an airfoil portion of a turbine engine component with a new and useful embodiment of a trailing edge microcircuit scheme.
Figure 4:
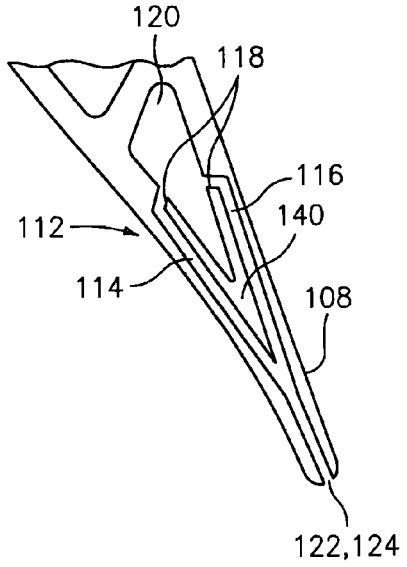
FIG. 4 is an enlarged view of the trailing edge microcircuit scheme of FIG. 3.

FIGS. 3 and 4 illustrate an airfoil portion 100 of a turbine engine component such as a turbine blade or vane. The airfoil portion 100 has a pressure side wall 102 and a suction side wall 104. The airfoil portion 100 also has a leading edge 106 and a trailing edge 108. The airfoil portion 100 when formed has a number of cooling circuit cores 110 through which cooling fluid may flow to a number of microcircuits (not shown) embedded into the pressure and suction side walls 102 and 104.

As can be seen from FIGS. 3 and 4, the airfoil portion 100 also has a trailing edge microcircuit or cooling system 112 for cooling the trailing edge 108 of the airfoil portion. The microcircuit 112 may be characterized by at least one pressure side cooling circuit core 114 embedded within the pressure side wall 102 and at least one suction side cooling circuit core 116 embedded within the suction side wall 104. Each said cooling circuit core 114 and 116 has an inlet 118 which communicates with a source of cooling fluid, such as engine bleed air. For example, each inlet 118 may communicate with a central core 120 through which flows the cooling fluid. Further, each pressure side cooling circuit core 114 has an exit 122, while each suction side cooling circuit core 116 has an exit 124.

Figure 5:
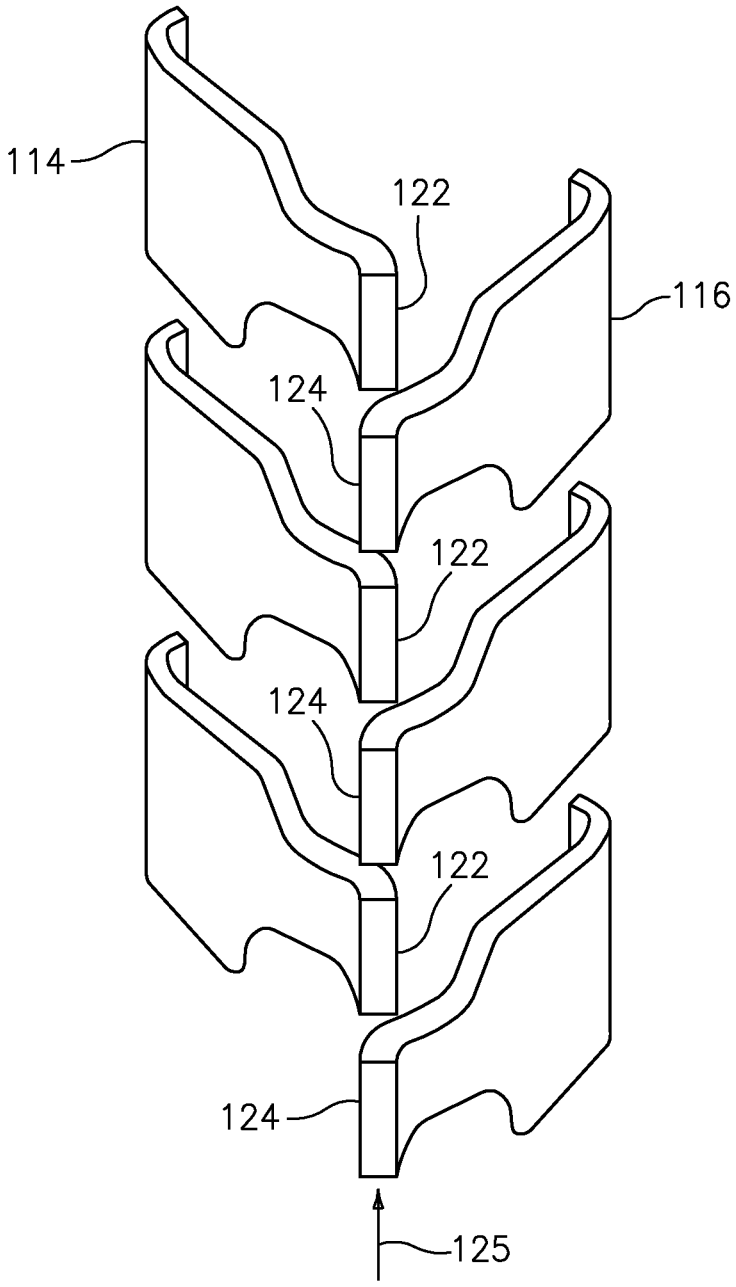
FIG. 5 is a 3-D drawing showing an example of the trailing edge microcircuit of FIG. 3.

As can be seen from FIGS. 3 and 4, both cooling circuit cores 114 and 116 exit in the same location, such as a center discharge or a cutback trailing edge. This may be accomplished by converging, or narrowing the microcircuit cores 114 and 116 in a radial direction, and alternating the exits 122 and 124 as shown in FIG. 5. Further, as shown in FIG. 5, the exits 122 and 124 may be aligned in a spanwise direction 125 of the airfoil portion 100.

Figure 6:
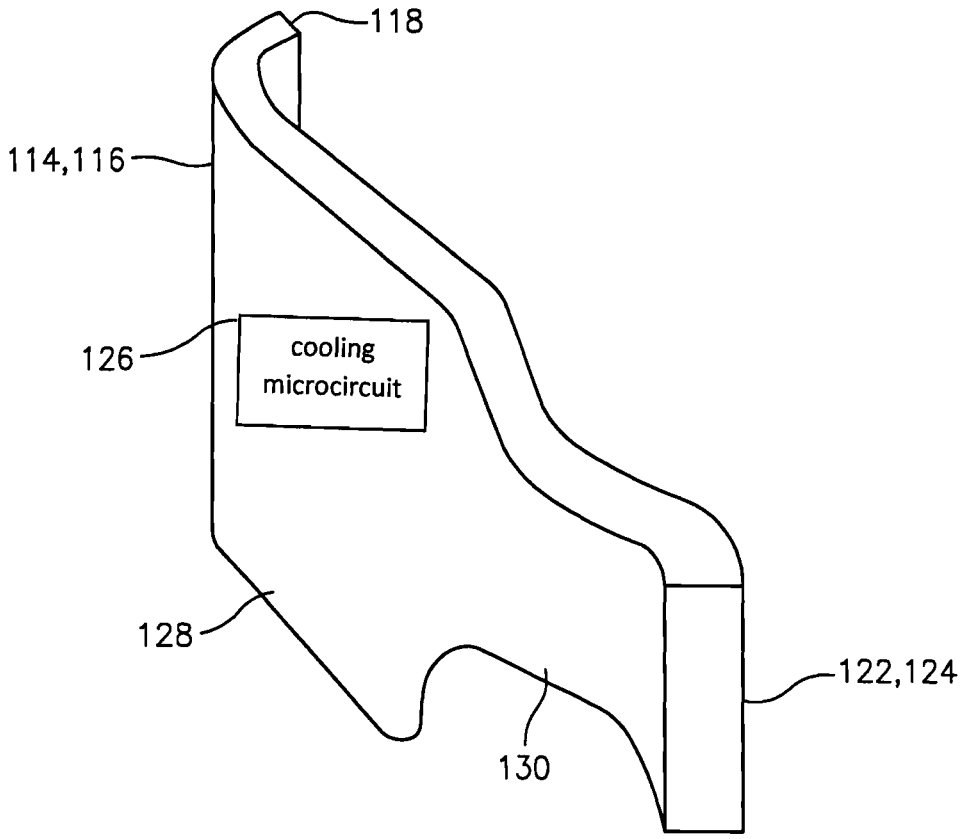
FIG. 6 illustrates the features of an individual microcircuit used in the scheme of FIG. 3.

FIG. 6 shows the possible features of each one of the cooling circuit cores 114 and 116. As can be seen from this figure, each cooling circuit core 114 and 116 may have an inlet 118, a cooling microcircuit 126 which may comprise any suitable cooling microcircuit such as an axial pin fin array microcircuit, a non-convergent section 128, a convergent section 130, and a trailing edge exit 122 or 124.

Figure 7:
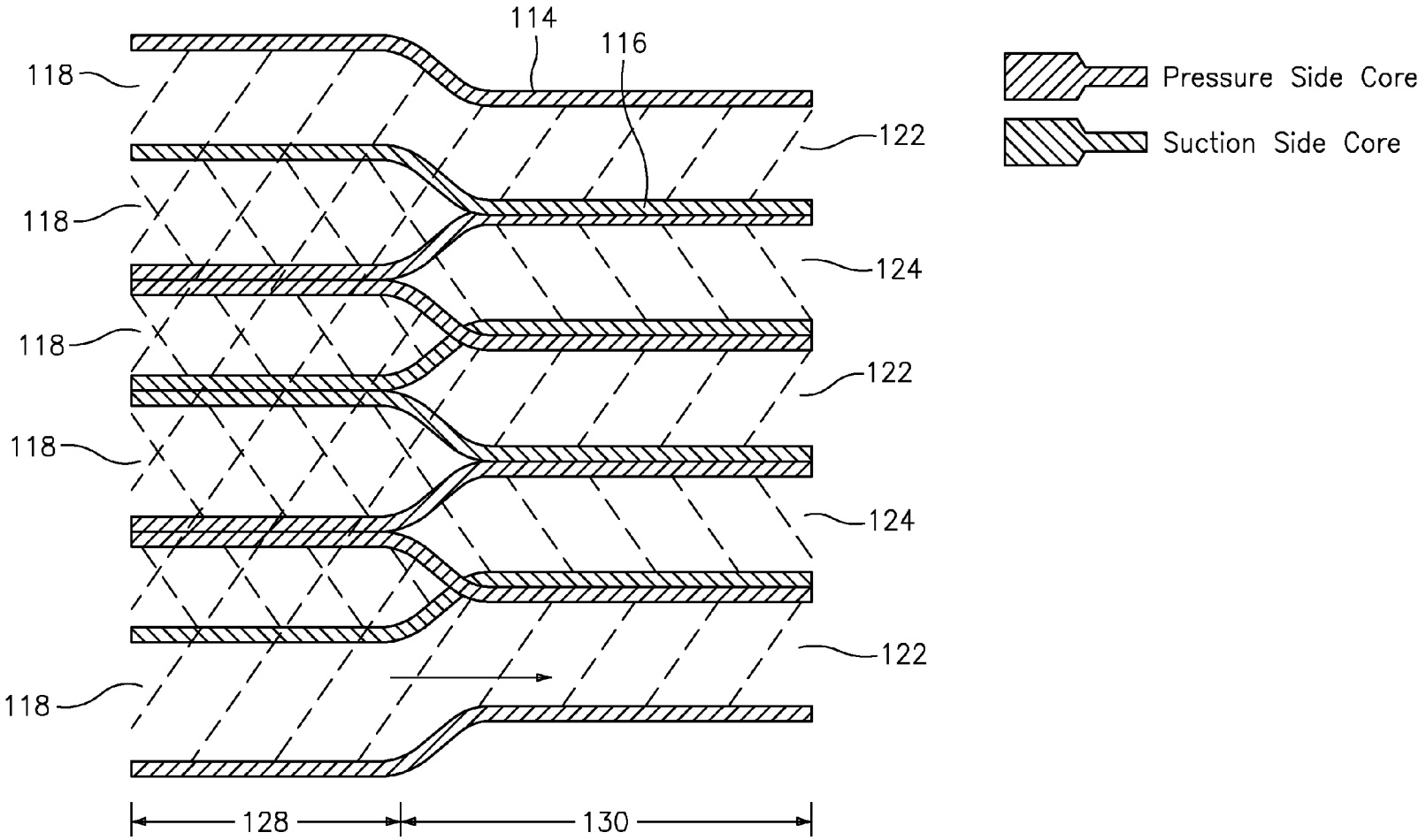
FIG. 7 illustrates the alternating trailing edge exits of the trailing edge microcircuits.

FIG. 7 shows a staggered arrangement of the pressure side cores 114 and the suction side cores 116 which leads to the alternating trailing edge exits 122 and 124. This figure also shows the non-convergent section 128 and the convergent section 130.

As shown in FIG. 3, the pressure side core(s) 114 and the suction side core(s) 116 converge towards each other. A wedge 140 may be positioned between the converging core(s) 114 and 116.

Each cooling circuit core 114 and 116 may be fabricated using any suitable technique known in the art. For example, each of the cooling circuit cores 114 and 116 may be formed using refractory metal core technology in which the airfoil portion 100 is cast around the refractory metal cores and after solidification, the refractory metal cores are removed.

The full coverage trailing edge microcircuit with alternating converging exits described herein should provide several aero-thermal benefits. As can be seen from the foregoing description, the pressure and suction side walls of the airfoil portion 100 are fully covered. Additionally, heat is only being drawn into each microcircuit from a single hot wall in the non-converging zone 128. The opposite side of each core is shielded by the opposite wall core. In the convergent section 130 of each core, heat is drawn from both hot walls. The trailing edge provides a low-pressure sink for flow to be discharged. Due to the significant pressure ratio across each core, substantial convective heat transfer can be achieved by dumping flow out in this location. Because the cooling circuit cores 114 and 116 converge at the trailing edge, Mach numbers in the passage should increase as they reach the end of the circuit. This Mach number increase should increase the flow per unit area in the core and thus should increase internal heat transfer coefficients. Conversely, the non-convergent portion 130 of the microcircuit should produce lower heat transfer coefficients and thus likely reduce the amount of heat-up in this region of the airfoil portion 100. Because external heat loads should increase externally as one move aft along the airfoil portion 100, the cooling scheme described herein provides a balance of low heat up/low heat transfer in the beginning of the circuit, moving to high heat up/high heat transfer at the end of the circuit. Thus, this configuration provides for an improved heat transfer, which will result in a cooler, more isothermal trailing edge. There should also be an aerodynamic benefit to the high Mach number at the core exits 122 and 124. The high exit velocity of the coolant better matches the external free stream velocity and thus should reduce aerodynamic mixing losses.

Additional structural benefits may exist from the wedge 140 (see FIGS. 3 and 4) of the metal left between the two trailing edge cores 114 and 116 after the cores 114 and 116 have been formed. This internal wedge 140 may provide stiffness to the trailing edge to combat creep and help dampen vibrations. If desired, the cores 114 and 116 and/or the microcircuits can be altered to change the shape of the trailing edge internal wedge 140.

The invention may also increase the thermal effective of the airfoil portion in which it is incorporated, while reducing the required cooling air discharged into the gas path and the aforementioned aerodynamic losses.

Figure 1:
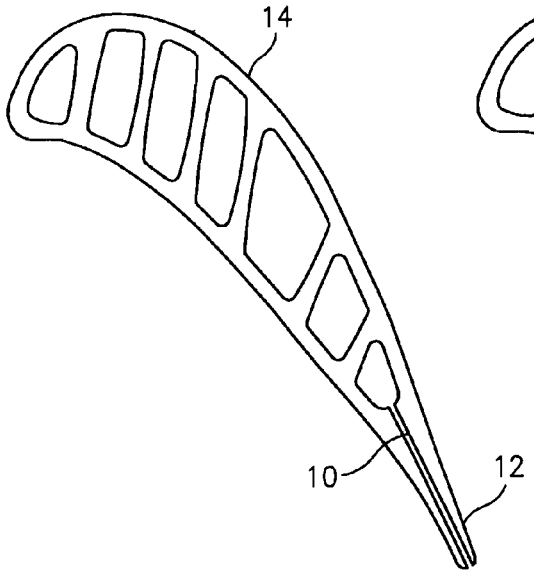
FIG. 1 (PRIOR ART)
FIG. 1 illustrates a first embodiment of a trailing edge microcircuit scheme.
Figure 2:
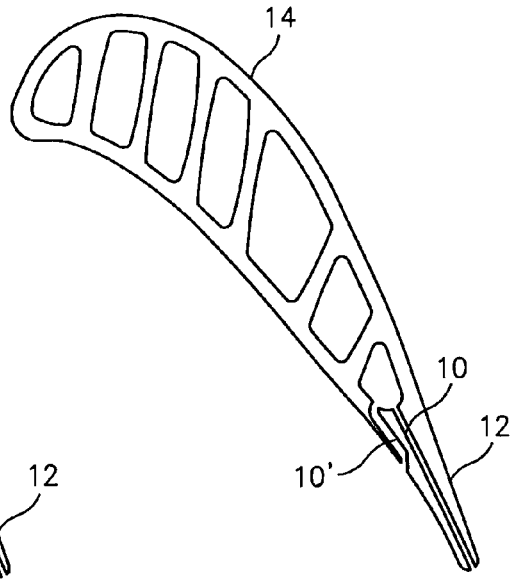
FIG. 2 (PRIOR ART)
FIG. 2 illustrates a second embodiment of a trailing edge microcircuit scheme.

While the core 116 has been shown as originating from the suction side of mainbody core as depicted in FIGS. 3 and 4, it may connect with mainbody core in a manner similar to the centered microcircuit 10 in FIG. 1 and then weave with the core 114.

It is apparent that there has been provided an inventive microcircuit design. Other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component having an airfoil portion with a pressure side wall, a suction side wall, and a trailing edge, said component comprising:

at least one first cooling circuit core embedded within the pressure side wall;

each said first cooling circuit core having a first exit for discharging a cooling fluid;

at least one second cooling circuit core embedded within the suction side wall;

each said second cooling circuit core having a second exit for discharging a cooling fluid; and said first and second exits being aligned in a spanwise direction of said airfoil portion, wherein each of said first and second cooling circuit cores has a cooling microcircuit, a non-convergent section adjacent said cooling microcircuit, and a spanwise convergent section adjacent said non-convergent section.

2. The turbine engine component according to claim 1, further comprising a plurality of first cooling circuit cores embedded within the pressure side wall and a plurality of second cooling circuit cores embedded within the suction side wall and a plurality of first exits and a plurality of second exits being aligned in said spanwise direction.

3. The turbine engine component according to claim 1, wherein said first and second exits exit in a location in a center of the trailing edge.

4. The turbine engine component according to claim 1, wherein said first and second exits exit in a location which is a cutback trailing edge.

5. The turbine engine component according to claim 1, wherein each said first cooling circuit core converges towards each said second core.

6. The turbine engine component according to claim 5, further comprising a wedge located between said at least one first cooling circuit core and said at least one second cooling circuit core.

7. The turbine engine component according to claim 1, wherein each said first cooling circuit core has a first inlet for receiving cooling fluid and each said second cooling circuit core has a second inlet for receiving cooling fluid.

8. The turbine engine component according to claim 7, wherein each said first inlet and each said second inlet receive said cooling fluid from a common source.

9. The turbine engine component according to claim 1, wherein said convergent section in each said first cooling circuit core is located adjacent each said first exit and wherein said convergent section in each said second cooling circuit core is located adjacent each said second exit.

10. A process for forming a turbine engine component comprising the steps of:

forming an airfoil portion having a pressure side wall, a suction side wall, and a trailing edge;

forming a trailing edge cooling system which comprises at least one first cooling circuit core within said pressure side wall and at least one second cooling circuit core having within said suction side wall;

forming said at least one first cooling circuit core to have a first exit and forming said at least one second cooling circuit core to have a second exit aligned with said first exit in a spanwise direction of said airfoil portion; and forming each of said first and second cooling circuit cores with a cooling microcircuit, a non-convergent section adjacent said cooling microcircuit, and a convergent section having a portion which converges in a spanwise direction adjacent said non-convergent section.

11. The process according to claim 10, wherein said trailing edge cooling system forming step comprises forming a plurality of first cooling circuit cores embedded within the pressure side wall and forming a plurality of second cooling circuit cores embedded within the suction side wall and forming a plurality of first exits and a plurality of second exits aligned in said spanwise direction.

12. The process according to claim 10, wherein said forming step further comprises forming said first and second exits to exit at a center of the trailing edge.

13. The process according to claim 10, wherein said forming step further comprises forming said first and second exits to exit at a cutback trailing edge.

14. The process according to claim 10, wherein said forming step comprises forming each said first cooling circuit core to converge towards each said second cooling circuit core.

15. The process according to claim 14, further comprising forming a wedge between said at least one first cooling circuit core and said at least one second cooling circuit core.

16. The process according to claim 10, further comprising forming each said first cooling circuit core with a first inlet for receiving cooling fluid and each said second cooling circuit core with a second inlet for receiving cooling fluid.

17. The process according to claim 16, further comprising arranging each said first inlet and each said second inlet so as to receive said cooling fluid from a common source.

18. The process according to claim 10, further comprising locating said convergent section in each said first cooling circuit core adjacent each said first exit and locating said convergent section in each said second cooling circuit core adjacent each said second exit.

* * * * *